US007410246B2

(12) United States Patent
Bell et al.

(10) Patent No.: US 7,410,246 B2
(45) **Date of Patent: *Aug. 12, 2008**

(54) HEATER CHIP CONFIGURATION FOR AN INKJET PRINTHEAD AND PRINTER

(75) Inventors: Byron Vencent Bell, Paris, KY (US); Robert Wilson Cornell, Lexington, KY (US); Yimin Guan, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 759 days.

This patent is subject to a terminal disclaimer.

(21) Appl. No.: 10/619,975

(22) Filed: Jul. 15, 2003

(65) Prior Publication Data

US 2004/0021740 A1 Feb. 5, 2004

Related U.S. Application Data

(63) Continuation of application No. 10/146,578, filed on May 14, 2002, now abandoned.

(51) Int. Cl.
*B41J 2/05* (2006.01)

(52) U.S. Cl. ..... 347/62; 347/64

(58) Field of Classification Search ..... 347/56–59, 347/61–65, 20, 44, 47, 54, 67
See application file for complete search history.

(56) References Cited

U.S. PATENT DOCUMENTS

| | | | | |
|---|---|---|---|---|
| 4,338,611 A | | 7/1982 | Eida et al. | 347/63 |
| 4,567,493 A | * | 1/1986 | Ikeda et al. | 347/64 |
| 4,635,073 A | * | 1/1987 | Hanson | 347/50 |
| 5,270,730 A | * | 12/1993 | Yaegashi et al. | 347/56 |
| 6,139,131 A | | 10/2000 | Prasad et al. | 347/63 |

FOREIGN PATENT DOCUMENTS

JP 404255357 A 9/1992

* cited by examiner

*Primary Examiner*—Juanita D Stephens
(74) *Attorney, Agent, or Firm*—King & Schickli, PLLC

(57) ABSTRACT

A heater chip has a plurality of heaters each having a length, width and thickness. The length multiplied by the width (heater area) is in a range from about 50 to about 500 micrometers squared while the thickness is in a range from about 500 to about 5000 or 6000 angstroms. The energy required to jet or emit a single drop of ink from the heater during use is in a range from about 0.007 to about 0.99 or 1.19 microjoules. The heater chip is formed as a plurality of thin film layers on a substrate. Energy ranges are taught for all heaters having an area from about 50 to about 4000 micrometers squared and thicknesses ranging from about 500 to about 16,000 angstroms. Printheads containing the heater chip and printers containing the printheads are also disclosed.

25 Claims, 12 Drawing Sheets

| ENERGY RANGE (μJOULES) REQUIRED FOR STABLE JETTING PERFORMANCE | | | | | | | | |
|---|---|---|---|---|---|---|---|---|
| HEATER AREA ($\mu m^2$) | HEATER THICKNESS, TH, (ANGSTROMS) | | | | | | | |
| | 1000 | 2000 | 3000 | 4000 | 5000 | 6000 | 7000 | 8000 |
| 50 | 0.01-0.02 | 0.03-0.04 | 0.04-0.06 | 0.06-0.08 | 0.07-1.10 | 0.09-0.12 | 0.10-0.14 | 0.12-0.16 |
| 100 | 0.03-0.04 | 0.06-0.08 | 0.09-0.12 | 0.12-0.16 | 0.15-0.20 | 0.18-0.24 | 0.21-0.28 | 0.24-0.32 |
| 150 | 0.04-0.06 | 0.09-0.12 | 0.13-0.18 | 0.18-0.24 | 0.22-0.30 | 0.26-0.36 | 0.31-0.42 | 0.35-0.48 |
| 200 | 0.06-0.08 | 0.12-1.16 | 0.18-0.24 | 0.24-0.32 | 0.29-0.4 | 0.35-0.48 | 0.41-0.56 | 0.47-0.64 |
| 250 | 0.07-0.1 | 0.15-0.2 | 0.22-0.3 | 0.29-0.4 | 0.37-0.5 | 0.44-0.6 | 0.51-0.69 | 0.59-0.79 |
| 300 | 0.09-0.12 | 0.18-0.24 | 0.26-0.36 | 0.35-0.48 | 0.44-0.6 | 0.53-0.71 | 0.62-0.83 | 0.71-0.95 |
| 350 | 0.1-0.14 | 0.21-0.28 | 0.31-0.42 | 0.41-0.56 | 0.51-0.69 | 0.62-0.83 | 0.72-0.97 | 0.82-1.11 |
| 400 | 0.12-0.16 | 0.24-0.32 | 0.35-0.48 | 0.47-0.64 | 0.59-0.79 | 0.71-0.95 | 0.82-1.11 | 0.94-1.27 |
| 450 | 0.13-0.18 | 0.26-0.36 | 0.4-0.54 | 0.53-0.71 | 0.66-0.89 | 0.79-1.07 | 0.93-1.25 | 1.06-1.43 |
| 500 | 0.15-0.2 | 0.29-0.4 | 0.44-0.6 | 0.59-0.78 | 0.74-0.99 | 0.88-1.19 | 1.03-1.39 | 1.18-1.59 |
| 550 | 0.16-0.22 | 0.32-0.44 | 0.49-0.66 | 0.65-0.87 | 0.81-1.09 | 0.97-1.31 | 1.13-1.53 | 1.29-1.75 |
| 600 | 0.18-0.24 | 0.35-0.48 | 0.53-0.71 | 0.71-0.95 | 0.88-1.19 | 1.06-1.43 | 1.23-1.67 | 1.41-1.91 |
| 650 | 0.19-0.26 | 0.38-0.52 | 0.57-0.77 | 0.76-1.06 | 0.96-1.29 | 1.15-1.55 | 1.34-1.81 | 1.53-2.06 |
| 700 | 0.21-0.28 | 0.41-0.56 | 0.62-0.83 | 0.82-1.11 | 1.03-1.39 | 1.23-1.67 | 1.44-1.95 | 1.65-2.22 |
| 750 | 0.22-0.3 | 0.44-0.6 | 0.66-0.89 | 0.88-1.19 | 1.1-1.49 | 1.32-1.79 | 1.54-2.08 | 1.76-2.38 |
| 800 | 0.24-0.32 | 0.47-0.64 | 0.71-0.95 | 0.94-1.27 | 1.18-1.59 | 1.41-1.91 | 1.65-2.22 | 1.88-2.54 |
| 850 | 0.25-0.34 | 0.5-0.67 | 0.75-1.01 | 1.0-1.35 | 1.25-1.69 | 1.5-2.02 | 1.75-2.36 | 2.0-2.7 |
| 900 | 0.26-0.36 | 0.53-0.71 | 0.79-1.07 | 1.06-1.43 | 1.32-1.79 | 1.59-2.14 | 1.85-2.5 | 2.12-2.86 |
| 950 | 0.28-0.38 | 0.56-0.75 | 0.84-1.13 | 1.12-1.51 | 1.4-1.89 | 1.68-2.26 | 1.96-2.64 | 2.23-3.02 |
| 1000 | 0.29-0.4 | 0.59-0.79 | 0.88-1.19 | 1.18-1.59 | 1.47-1.99 | 1.76-2.38 | 2.06-2.78 | 2.35-3.18 |
| 1050 | 0.31-0.42 | 0.62-0.83 | 0.93-1.25 | 1.23-1.67 | 1.54-2.08 | 1.85-2.5 | 2.16-2.92 | 2.47-3.33 |
| 1100 | 0.32-0.44 | 0.65-0.87 | 0.97-1.31 | 1.29-1.75 | 1.62-2.18 | 1.94-2.62 | 2.26-3.06 | 2.59-3.49 |
| 1200 | 0.35-0.48 | 0.71-0.95 | 1.06-1.43 | 1.41-1.91 | 1.76-2.38 | 2.12-2.86 | 2.47-3.33 | 2.82-3.81 |
| 1300 | 0.38-0.52 | 0.76-1.03 | 1.15-1.55 | 1.53-2.06 | 1.91-2.58 | 2.29-3.1 | 2.68-3.61 | 3.06-4.13 |
| 1400 | 0.41-0.56 | 0.82-1.11 | 1.23-1.67 | 1.65-2.22 | 2.06-2.78 | 2.47-3.33 | 2.88-3.89 | 3.29-4.45 |
| 1500 | 0.44-0.6 | 0.88-1.19 | 1.32-1.79 | 1.76-2.38 | 2.21-2.98 | 2.65-3.57 | 3.09-4.17 | 3.53-4.76 |
| 2000 | 0.59-0.79 | 1.18-1.59 | 1.76-2.38 | 2.35-3.18 | 2.94-3.97 | 3.53-4.76 | 4.12-5.56 | 4.7-6.35 |
| 2500 | 0.74-0.99 | 1.47-1.99 | 2.21-2.98 | 2.94-3.97 | 3.68-4.96 | 4.41-5.96 | 5.15-6.95 | 5.88-7.94 |
| 3000 | 0.88-1.19 | 1.76-2.38 | 2.65-3.57 | 3.53-4.76 | 4.41-5.96 | 5.29-7.15 | 6.17-8.34 | 7.06-9.53 |
| 3500 | 1.03-1.39 | 2.06-2.78 | 3.09-4.17 | 4.12-5.56 | 5.15-6.95 | 6.17-8.34 | 7.2-9.73 | 8.23-11.1 |
| 4000 | 1.18-1.59 | 2.35-3.18 | 3.53-4.76 | 4.7-6.35 | 5.88-7.94 | 7.06-9.53 | 8.23-11.1 | 9.41-12.7 |

Fig.10

| ENERGY RANGE ($\mu$JOULES) REQUIRED FOR STABLE JETTING PERFORMANCE | | | | | | | | |
|---|---|---|---|---|---|---|---|---|
| HEATER AREA ($\mu m^2$) | HEATER THICKNESS, TH, (ANGSTROMS) | | | | | | | |
| | 9000 | 10000 | 11000 | 12000 | 13000 | 14000 | 15000 | 16000 |
| 50 | 0.13-0.18 | 0.15-0.20 | .016-0.22 | 0.18-0.24 | 0.19-0.26 | 0.21-0.30 | 0.22-0.30 | 0.24-0.32 |
| 100 | 0.26-0.36 | 0.29-0.40 | 0.32-0.44 | 0.35-0.48 | 0.38-0.48 | 0.38-0.52 | 0.44-0.60 | 0.47-0.64 |
| 150 | 0.40-0.54 | 0.44-0.60 | 0.49-0.66 | 0.53-0.71 | 0.57-0.77 | 0.62-0.83 | 0.66-0.89 | 0.71-0.95 |
| 200 | 0.53-0.71 | 0.59-0.79 | 0.65-0.87 | 0.71-0.95 | 0.76-1.03 | 0.82-1.11 | 0.88-1.19 | 0.94-1.27 |
| 250 | 0.66-0.89 | 0.74-0.99 | 0.81-1.09 | 0.88-1.19 | 0.96-1.29 | 1.03-1.39 | 1.1-1.49 | 1.18-1.59 |
| 300 | 0.79-1.07 | 0.88-1.19 | 0.97-1.31 | 1.06-1.43 | 1.15-1.55 | 1.23-1.67 | 1.32-1.79 | 1.41-1.91 |
| 350 | 0.93-1.25 | 1.03-1.39 | 1.13-1.53 | 1.23-1.67 | 1.34-1.81 | 1.44-1.95 | 1.54-2.08 | 1.65-2.22 |
| 400 | 1.06-1.43 | 1.18-1.59 | 1.29-1.75 | 1.41-1.91 | 1.53-2.06 | 1.65-2.22 | 1.76-2.38 | 1.88-2.54 |
| 450 | 1.19-1.61 | 1.32-1.79 | 1.46-1.97 | 1.59-2.14 | 1.72-2.32 | 1.85-2.5 | 1.98-2.68 | 2.12-2.86 |
| 500 | 1.32-1.79 | 1.47-1.99 | 1.62-2.18 | 1.76-2.38 | 1.91-2.58 | 2.06-2.78 | 2.21-2.98 | 2.35-3.18 |
| 550 | 1.46-1.97 | 1.62-2.18 | 1.78-2.4 | 1.94-2.62 | 2.1-2.84 | 2.26-3.06 | 2.43-3.28 | 2.59-3.49 |
| 600 | 1.59-2.14 | 1.76-2.38 | 1.94-2.62 | 2.12-2.86 | 2.29-3.1 | 2.47-3.33 | 2.65-3.57 | 2.82-3.81 |
| 650 | 1.72-2.32 | 1.91-2.58 | 2.1-2.84 | 2.29-3.1 | 2.48-3.35 | 2.68-3.61 | 2.87-3.87 | 3.06-4.13 |
| 700 | 1.85-2.5 | 2.06-2.78 | 2.26-3.06 | 2.47-3.33 | 2.68-3.61 | 2.88-3.89 | 3.09-4.17 | 3.29-4.45 |
| 750 | 1.98-2.68 | 2.21-2.98 | 2.43-3.28 | 2.65-3.57 | 2.87-3.87 | 3.09-4.17 | 3.31-4.47 | 3.53-4.76 |
| 800 | 2.12-2.86 | 2.35-3.18 | 2.59-3.49 | 2.82-3.81 | 3.06-4.13 | 3.29-4.45 | 3.53-4.76 | 3.76-5.08 |
| 850 | 2.25-3.04 | 2.5-3.37 | 2.75-3.71 | 3.0-4.05 | 3.25-4.39 | 3.5-4.72 | 3.75-5.06 | 4.0-5.4 |
| 900 | 2.38-3.22 | 2.65-3.57 | 2.91-3.93 | 3.18-4.29 | 3.44-4.64 | 3.7-5 | 3.97-5.36 | 4.23-5.72 |
| 950 | 2.51-3.39 | 2.79-3.77 | 3.07-4.15 | 3.35-4.53 | 3.63-4.9 | 3.91-5.28 | 4.19-5.66 | 4.47-6.03 |
| 1000 | 2.65-3.57 | 2.94-3.97 | 3.23-4.37 | 3.53-4.76 | 3.82-5.16 | 4.12-5.56 | 4.41-5.96 | 4.7-6.35 |
| 1050 | 2.78-3.75 | 3.09-4.17 | 3.4-4.59 | 3.7-5.0 | 4.01-5.42 | 4.32-5.84 | 4.63-6.25 | 4.94-6.67 |
| 1100 | 2.91-3.93 | 3.23-4.37 | 3.56-4.8 | 3.88-5.24 | 4.2-5.68 | 4.53-6.11 | 4.85-6.53 | 5.17-6.99 |
| 1200 | 3.18-4.29 | 3.53-4.76 | 3.88-5.24 | 4.23-5.72 | 4.59-6.19 | 4.94-6.67 | 5.29-7.15 | 5.64-7.62 |
| 1300 | 3.44-4.64 | 3.82-5.16 | 4.2-5.68 | 4.59-6.19 | 4.97-6.71 | 5.35-7.23 | 5.73-7.74 | 6.12-8.26 |
| 1400 | 3.7-5.0 | 4.12-5.56 | 4.53-6.11 | 4.94-6.67 | 5.35-7.23 | 5.76-7.78 | 6.17-8.34 | 6.59-8.89 |
| 1500 | 3.97-5.36 | 4.41-5.96 | 4.85-6.55 | 5.29-7.15 | 5.73-7.74 | 6.17-8.34 | 6.61-8.93 | 7.06-9.53 |
| 2000 | 5.29-7.15 | 5.88-7.94 | 6.47-8.73 | 7.06-9.53 | 7.64-10.3 | 8.23-11.1 | 8.82-11.9 | 9.41-12.7 |
| 2500 | 6.62-8.93 | 7.35-9.93 | 8.1-10.9 | 8.82-11.9 | 9.6-12.9 | 10.3-13.9 | 11.0-14.9 | 11.8-15.9 |
| 3000 | 7.94-10.7 | 8.82-11.9 | 9.7-13.1 | 10.6-14.3 | 11.5-15.5 | 12.4-16.7 | 13.2-17.9 | 14.1-19.1 |
| 3500 | 9.3-12.5 | 10.3-13.9 | 11.3-15.3 | 12.4-16.7 | 13.4-18.1 | 14.4-19.5 | 15.4-20.8 | 16.5-22.2 |
| 4000 | 10.6-14.3 | 11.8-15.9 | 12.9-17.5 | 14.1-19.1 | 15.3-20.6 | 16.5-22.2 | 17.6-23.8 | 18.8-25.4 |

Fig.11

| ENERGY RANGE ($\mu$JOULES) REQUIRED FOR STABLE JETTING PERFORMANCE | |
|---|---|
| HEATER AREA ($\mu m^2$) | HEATER THICKNESS, TH, (ANGSTROMS) |
| | 500 |
| 50 | 0.007-0.01 ~200 |
| 100 | 0.01-0.02 |
| 150 | 0.02-0.03 |
| 200 | 0.03-0.04 |
| 250 | 0.04-0.05 |
| 300 | 0.04-0.06 |
| 350 | 0.05-0.07 |
| 400 | 0.06-0.08 |
| 450 | 0.07-0.09 |
| 500 | 0.07-0.10 |
| 550 | 0.08-0.11 |
| 600 | 0.09-0.12 |
| 650 | 0.10-0.13 |
| 700 | 0.10-0.14 |
| 750 | 0.11-0.15 |
| 800 | 0.12-0.16 |
| 850 | 0.12-0.17 |
| 900 | 0.13-0.18 |
| 950 | 0.14-0.19 |
| 1000 | 0.15-0.20 |
| 1050 | 0.15-0.21 |
| 1100 | 0.16-0.22 |
| 1200 | 0.18-0.24 |
| 1300 | 0.19-0.26 |
| 1400 | 0.20-0.27 |
| 1500 | 0.22-0.30 |
| 2000 | 0.29-0.40 |
| 2500 | 0.37-0.50 |
| 3000 | 0.44-0.60 |
| 3500 | 0.51-0.69 |
| 4000 | 0.59-0.79 |

Fig.12

HEATER CHIP CONFIGURATION FOR AN INKJET PRINTHEAD AND PRINTER

This is a continuation application of U.S. patent application Ser. No. 10/146,578, entitled "Heater Chip Configuration for an Inkjet Printhead and Printer," filed on May 14, 2002 now abandoned.

FIELD OF THE INVENTION

The present invention relates to inkjet printheads. In particular, it relates to a thin film configuration of a heater chip of the printhead optimized to attain a particular energy range for stable ink jetting performance.

BACKGROUND OF THE INVENTION

The art of printing images with inkjet technology is relatively well known. In general, an image is produced by emitting ink drops from an inkjet printhead at precise moments such that they impact a print medium, such as a sheet of paper, at a desired location. The printhead is supported by a movable print carriage within a device, such as an inkjet printer, and is caused to reciprocate relative to an advancing print medium and emit ink drops at such times pursuant to commands of a microprocessor or other controller. The timing of the ink drop emissions corresponds to a pattern of pixels of the image being printed. Other than printers, familiar devices incorporating inkjet technology include fax machines, all-in-ones, photo printers, and graphics plotters, to name a few.

A conventional thermal inkjet printhead includes access to a local or remote supply of color or mono ink, a heater chip, a nozzle or orifice plate attached to the heater chip, and an input/output connector, such as a tape automated bond (TAB) circuit, for electrically connecting the heater chip to the printer during use. The heater chip, in turn, typically includes a plurality of thin film resistors or heaters fabricated by deposition, masking and etching techniques on a substrate such as silicon.

To print or emit a single drop of ink, an individual heater is uniquely addressed with a small amount of current to rapidly heat a small volume of ink. This causes the ink to vaporize in a local ink chamber (between the heater and nozzle plate) and be ejected through and projected by the nozzle plate towards the print medium.

As demands for higher resolution and increased printing speed continue, however, heater chips are made smaller with more and denser heater configurations. Thus, heater chip size, fragility, life, and heat dissipation becomes implicated with all future designs. In addition, printheads accrue fewer costs when heater chips use as little energy as possible when firing each heater.

Accordingly, the inkjet printhead arts desire optimum heater configurations requiring little firing energy that support relatively long life, small size, high density, chip stability and good heat dissipation properties.

SUMMARY OF THE INVENTION

The above-mentioned and other problems become solved by applying the apparatus and method principles and teachings associated with the hereinafter described heater chip configuration for an inkjet printhead and printer.

In one embodiment, the heater chip includes a heater having a length, width and thickness. The length multiplied by the width (heater area) is in a range from about 50 to about 500 micrometers squared while the thickness is in a range from about 500 to about 5000 or 6000 angstroms. In another embodiment, the heater area is less than about 400 micrometers squared while the thickness is less than about 4000 angstroms. The heater chip is formed as a plurality of thin film layers on a substrate. In particular, a thermal barrier layer is on the substrate, a resistor layer is on the thermal barrier layer, a conductor layer is on the resistor layer and an overcoat layer is on the resistor layer. The overcoat layer may include both a passivation and a cavitation layer. The conductor layer includes an anode and a cathode.

In other embodiments, the energy required to jet or emit a single drop of ink from the heater during use is in a range from about 0.007 to about 0.99 or about 1.19 microjoules. Energy ranges for heater chips are disclosed in tabular form for all heaters having an area ranging from about 50 to about 4000 micrometers squared and for thicknesses ranging from about 500 to about 16,000 angstroms.

Printheads containing the heater chip and printers containing the printheads are also taught.

These and other embodiments, aspects, advantages, and features of the present invention will be set forth in the description which follows, and in part will become apparent to those of ordinary skill in the art by reference to the following description of the invention and referenced drawings or by practice of the invention. The aspects, advantages, and features of the invention are realized and attained by means of the instrumentalities, procedures, and combinations particularly pointed out in the appended claims.

BRIEF DESCRIPTION OF THE DRAWINGS

FIG. 10 is a first table in accordance with the teachings of the present invention of the energy range required for an individual heater for stable jetting performance as a function of heater area and heater thickness;

FIG. 11 is a second table in accordance with the teachings of the present invention of the energy range required for an individual heater for stable jetting performance as a function of heater area and heater thickness; and FIG. 12 is a third table in accordance with the teachings of the present invention of the energy range required for an individual heater for stable jetting performance as a function of heater area and heater thickness;

DETAILED DESCRIPTION OF THE PREFERRED EMBODIMENTS

In the following detailed description of the preferred embodiments, reference is made to the accompanying drawings that form a part hereof, and in which is shown by way of illustration, specific embodiments in which the inventions may be practiced. These embodiments are described in sufficient detail to enable those skilled in the art to practice the invention, and it is to be understood that other embodiments may be utilized and that process, electrical or mechanical changes may be made without departing from the scope of the present invention. The terms wafer and substrate used in this specification include any base semiconductor structure such as silicon-on-sapphire (SOS) technology, silicon-on-insulator (SOI) technology, thin film transistor (TFT) technology, doped and undoped semiconductors, epitaxial layers of a silicon supported by a base semiconductor structure, as well as other semiconductor structures well known to one skilled in the art. The following detailed description is, therefore, not to be taken in a limiting sense, and the scope of the present invention is defined only by the appended claims and their equivalents.

Figure 1:
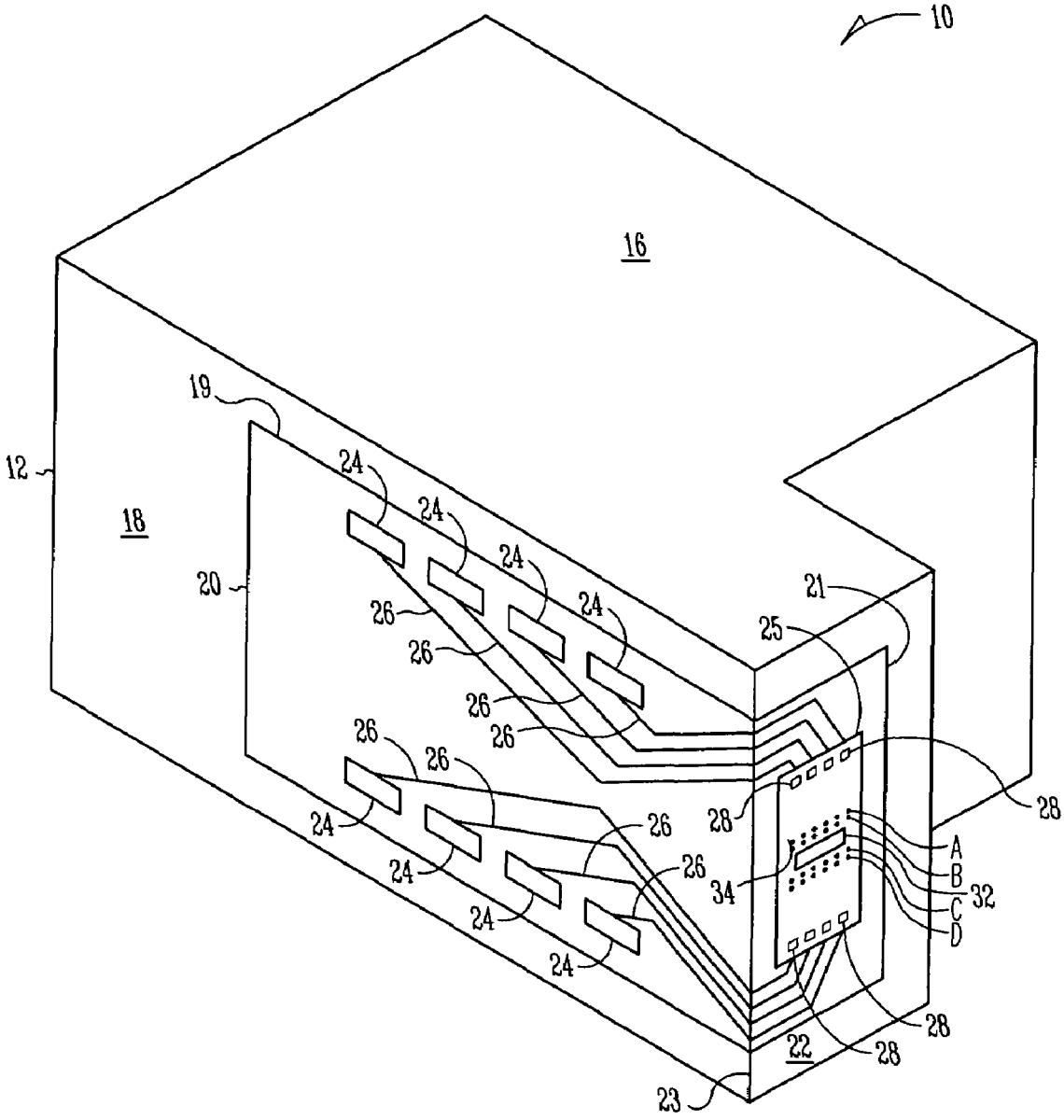
FIG. 1 is a perspective view in accordance with the teachings of the present invention of a thermal inkjet printhead.

With reference to FIG. 1, a printhead of the present invention having a heater chip incorporating thermal inkjet technology is shown generally as 10. The printhead 10 has a housing 12 formed of any suitable material, such as plastic, for holding ink. Its shape can be varied and is often dependent upon the external device that carries or contains the printhead. The housing has at least one compartment 16 internal thereto for holding an initial or refillable supply of ink. In one embodiment, the compartment is a singular chamber holding a supply of black ink, photo-ink, cyan ink, magenta ink or yellow ink. In another embodiment, the compartment is multi-chambered and contains three supplies of ink. Preferably, it includes cyan, magenta and yellow ink. In other embodiments, the compartment contains plural supplies of black, photo, cyan, magenta or yellow ink. A foam or lung insert, or other, may also accompany the supply of ink in the compartment 16 to provide a means for maintaining an appropriate level of compartment 16 backpressure during use. Such inserts are well known in the art. It will be appreciated that the compartment 16, while shown as locally integral within the housing 12, may alternatively be connected to a remote source of ink and fed from a supply tube, for example.

Adhered to one surface 18 of the housing 12 is a portion 19 of a tape automated bond (TAB) circuit 20. The other portion 21 of the TAB circuit 20 is adhered to another surface 22 of the housing. In this embodiment, the two surfaces 18, 22 are perpendicularly arranged to one another about an edge 23 of the housing.

The TAB circuit 20 has a plurality of input/output (I/O) connectors 24 fabricated thereon for electrically connecting the heater chip 25 to an external device, such as a printer, fax machine, copier, photo-printer, plotter, all-in-one, etc., during use. Pluralities of electrical conductors 26 exist on the TAB circuit 20 to electrically connect and short the I/O connectors 24 to the bond pads 28 of the heater chip 25 of the present invention. Various techniques are known for facilitating such connections. It will be appreciated that while eight I/O connectors 24, eight electrical conductors 26 and eight bond pads 28 are shown, any number greater than one are equally embraced herein. It is also to be appreciated that such number of connectors, conductors and bond pads may not be equal to one another, but for simplicity, equal numbers are shown. Even further, the connectors, conductors and bond pads, may assume other geometries and locations on the housing 12 and the heater chip 25.

The heater chip 25 is arranged on the surface 22 of the housing 12 as either a bottom, top or side of the printhead 10. In accordance with such arrangement, the printhead becomes known as a top- or roof-shooter style printhead and all embodiments are embraced herein.

The heater chip 25 contains at least one ink via 32 that is in fluidic access with one of the ink supplies contained in compartment 16. Each via is formed, preferably by any of the well known processes of grit blasting, deep reactive ion etching, ion etching, wet etching, laser cutting, or plunge cutting, in a substrate 34 of the heater chip. The heater chip 25 is preferably attached to the housing with any of a variety of adhesives, epoxies, etc. well known in the art. In another embodiment, the heater chip contains three ink vias having fluidic access to a cyan, yellow, magenta, and/or black ink supply in compartment 16.

The heater chip 25 contains at least one row of a plurality of heaters. As shown, four rows, Rows A, B, C and D, are arranged with two rows of heaters per longitudinal side of the ink via 32. Rows A and D are far rows of heaters while Rows B and C are near rows of heaters. Such rows of near and far heaters are a reference to a distance of the rows to the ink via. As implied by their names, the row of near heaters is closer in distance to the ink via than the row of far heaters. For simplicity in this crowded figure, the pluralities of heaters in rows A through D are shown as dots. It will be appreciated, however, that the rows of heaters may be further defined in staggered array groups, linear arrangements, stair-step profiles, or other relative relationships. In one embodiment, each row contains about 160 heaters.

Figure 2:
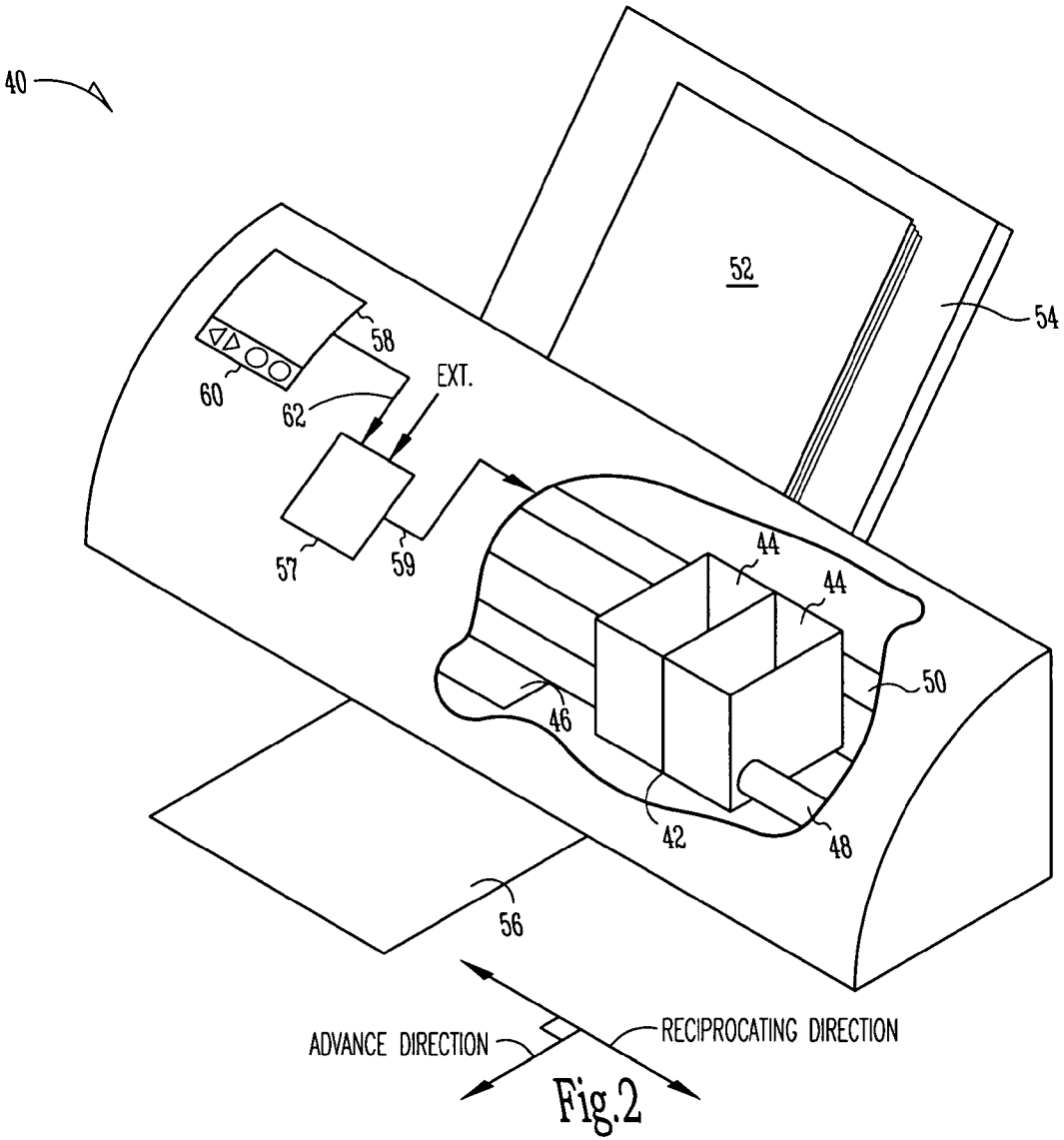
FIG. 2 is a perspective view in accordance with the teachings of the present invention of an inkjet printer.

With reference to FIG. 2, an external device, in the form of an inkjet printer, for containing the printhead 10 is shown generally as 40. The printer 40 includes a carriage 42 having a plurality of slots 44 for containing one or more printheads 10. The carriage 42 is caused to reciprocate (via an output 59 of a controller 57) along a shaft 48 above a print zone 46 by a motive force supplied to a drive belt 50 as is well known in the art. The reciprocation of the carriage 42 is performed relative to a print medium, such as a sheet of paper 52, that is advanced in the printer 40 along a paper path from an input tray 54, through the print zone 46, to an output tray 56.

In the print zone, the carriage 42 reciprocates in the Reciprocating Direction generally perpendicularly to the paper 52 being advanced in the Advance Direction as shown by the arrows. Ink drops from compartments 16 (FIG. 1) are caused to be ejected from the heater chip 25 at such times pursuant to commands of a printer microprocessor or other controller 57. The timing of the ink drop emissions corresponds to a pattern of pixels of the image being printed. Often times, such patterns are generated in devices electrically connected to the controller 57 (via Ext. input) that are external to the printer such as a computer, a scanner, a camera, a visual display unit, a personal data assistant, etc.

To print or emit a single drop of ink, the heaters (the dots of rows A-D, FIG. 1) are uniquely addressed in a particular order with a small amount of current to rapidly heat a small volume of ink. This causes the ink to vaporize in a local ink chamber 140 (FIG. 3A) and be ejected through, and projected by, a nozzle plate (not shown) towards the print medium. The fire pulse required to emit such an ink drop is typically in the form of a single or split firing pulse well known in the art.

A control panel 58 having user selection interface 60 may also be provided as an input 62 to the controller 57 to provide additional printer capabilities and robustness.

Figure 3A:
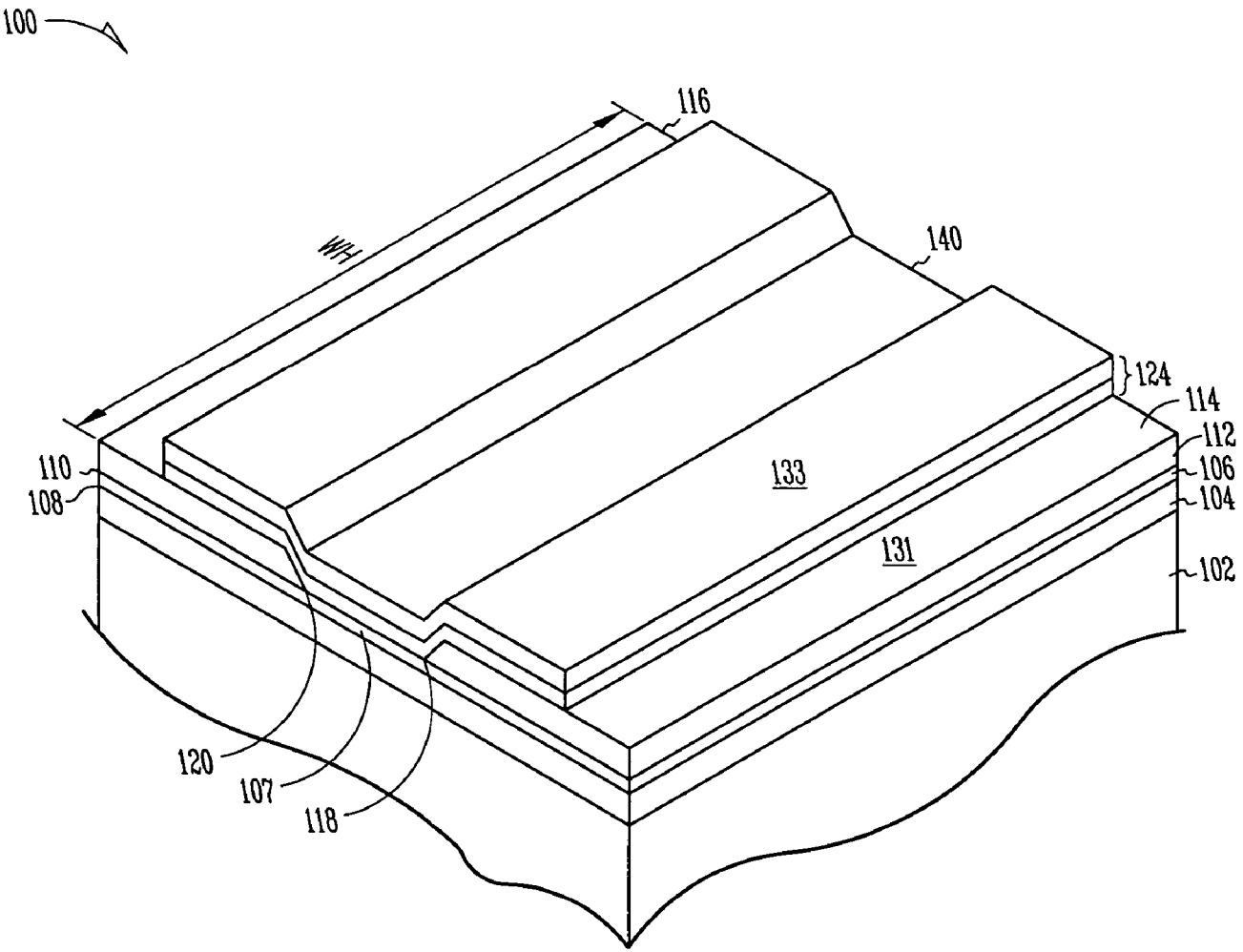
FIG. 3A is a perspective view in accordance with the teachings of the present invention of a thin film heater configuration.
Figure 3B:
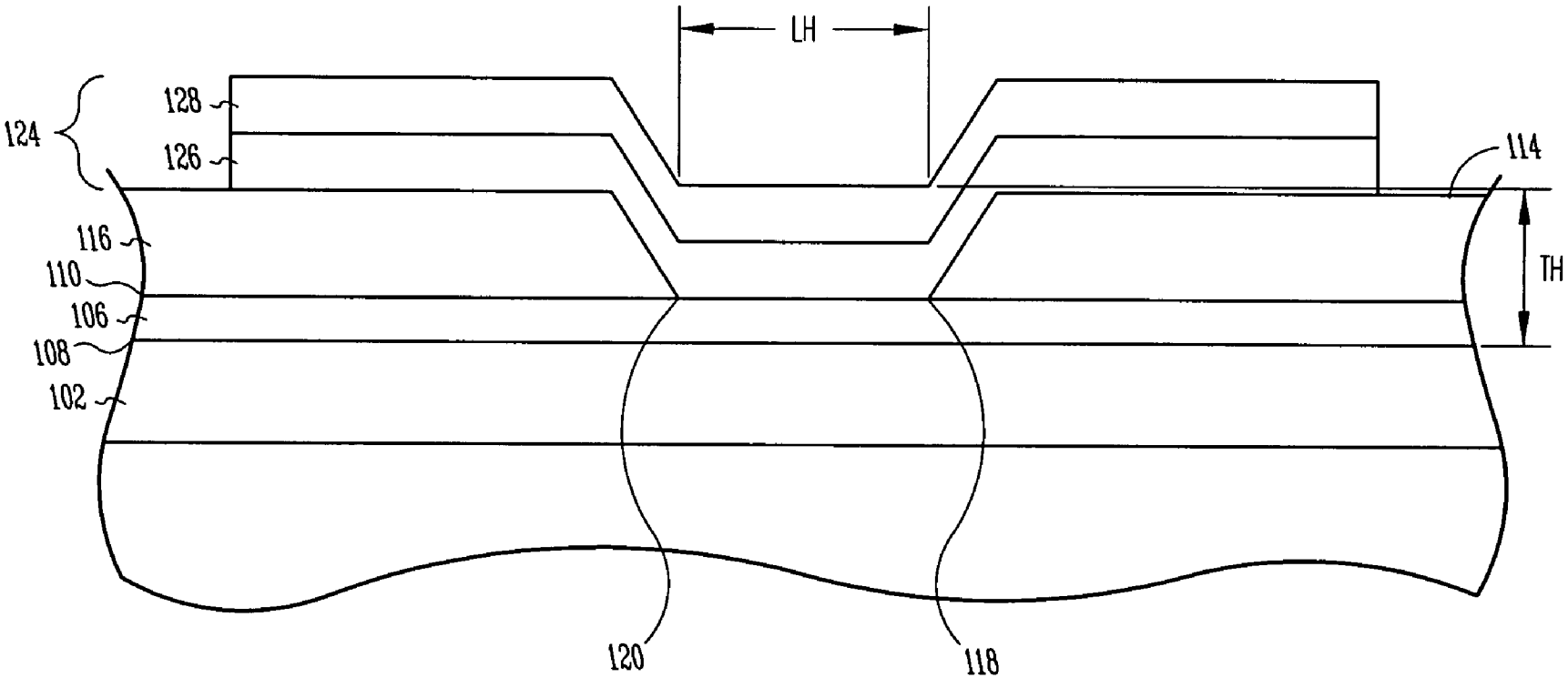
FIG. 3B is a cross sectional view in accordance with the teachings of the present invention of the thin film heater configuration of FIG. 3A.

With reference to FIGS. 3A and 3B, a more detailed embodiment of a portion of the heater chip 25 of the printhead 10 is shown. In particular, an individual heater of the pluralities of heaters in one of the near and/or far rows of heaters is shown generally as 100. It will be appreciated that what is depicted in this figure is the result of a substrate having been processed through a series of growth layers, deposition, masking, photolithography, and/or etching or other processing steps. Some of the preferred deposition techniques for the hereinafter described layers include, but are not limited to, any variety of chemical vapor depositions (CVD), physical vapor depositions (PVD), epitaxy, evaporation, sputtering or other similarly known techniques. Preferred CVD techniques include low pressure (LP) ones, but could also be atmospheric pressure (AP), plasma enhanced (PE), high density plasma (HDP) or other. Preferred etching techniques include, but are not limited to, any variety of wet or dry etches, reactive ion etches, deep reactive ion etches, etc. Preferred photolithography steps include, but are not limited to, exposure to ultraviolet or x-ray light sources, or other, and photomasking includes photomasking islands and/or photomasking holes. The particular embodiment, island or hole, depends upon whether the configuration of the mask is a clear-field or dark-field mask as those terms as well understood in the art.

The resulting heater 100 is a series of thin film layers. In particular, it is a substrate 102 that provides the base layer upon which all other layers will be formed. In one embodiment, the substrate is a silicon wafer of p-type, 100 orientation, having a resistivity of 5-20 ohm/cm. Its beginning thickness is preferably, but is not required to be, any one of 525+/−20 microns, 625+/−20 microns, or 625+/−15 microns with a respective wafer diameter of 100+/−0.50 mm, 125+/−0.50 mm, and 150+/−0.50 mm.

The next layer, which is on the substrate, is a thermal barrier layer 104. Some embodiments of the layer include a silicon oxide layer mixed with a glass, such as BPSG, PSG or PSOG, with an exemplary thickness of at least about 1 micron.

Subsequent to the thermal barrier layer, and disposed thereon, is a resistor layer 106. Preferably, the resistor layer is about a 50-50 atomic % tantalum-aluminum composition layer. In other embodiments, the resistor layer includes essentially pure or composition layers of any of the following: hafnium, Hf, tantalum, Ta, titanium, Ti, tungsten, W, hafnium-diboride, $HfB_2$, Tantalum-nitride, $Ta_2N$, TaAl(N,O), TaAlSi, TaSiC, Ta/TaAl layered resistor, Ti(N,O) and WSi(O).

A conductor layer 112 overlies a portion of the resistor layer 106 and includes an anode 114 and cathode 116. On a surface of the resistor layer 106 between the anode and cathode (as between points 118 and 120) is a distance that defines a heater length, LH, as shown in FIG. 3B of the present invention. In an area 107 generally beneath the heater length, the resistor layer 106 has a thickness ranging from a surface 108 to a surface 110 that defines a resistor thickness. A width of the resistor layer 106 also defines a heater width, WH, as shown in FIG. 3A.

In one embodiment, the conductor layer is about a 99.5-0.5% aluminum-copper composition of about 5000+/−10% angstroms thick. In other embodiments, the conductor layer includes pure or compositions of aluminum with 2% copper and aluminum with 4% copper.

An overcoat layer 124 generally overlies the resistor layer between points 118 and 120 and, outside of points 118 and 120, it overlies the conductor layer 112. The overcoat layer has a thickness generally from a top 131 of the conductor layer 112 to a top 133 of the overcoat layer 124. This overcoat thickness, when in an area generally above the surface of the resistor layer 106 between points 118 and 120, when combined with the resistor thickness, defines a thickness of the heater, TH. Preferably, but by no means a requirement, the overcoat layer 124 includes both a passivation layer 126 and a cavitation layer 128. In one embodiment, the passivation layer 126 is a dual layer of dielectrics. In another, it is two layers comprised of silicon-carbide (SiC) and silicon-nitride ($Si_3N_4$). The cavitation layer 128 is processed subsequent to the passivation layer and in one embodiment is a tantalum (Ta) layer. In another embodiment, the overcoat layer is merely a layer of dielectric material without a cavitation layer. In such an embodiment, however, the heater, having heater width, WH, length, LH, and thickness, TH, is caused to wear out faster because of corrosive effects from ink.

A nozzle plate, not shown, is eventually attached to the foregoing described heater 100 to direct and project ink drops, formed as bubbles in an ink chamber area 140 generally above the heater, onto a print medium during use.

As will be described in more detail hereinafter, it has been advantageously discovered, among other things, that the energy required to stably jet ink from an individual heater 100 is a function of heater area (heater width, WH, multiplied by heater length, LH) and thickness TH. FIGS. 10-12 disclose particular preferred energy ranges for heater chips for all heaters having a heater area ranging from about 50 to about 4000 micrometers squared and for thicknesses ranging from about 500 to about 16,000 angstroms.

Figure 4A:
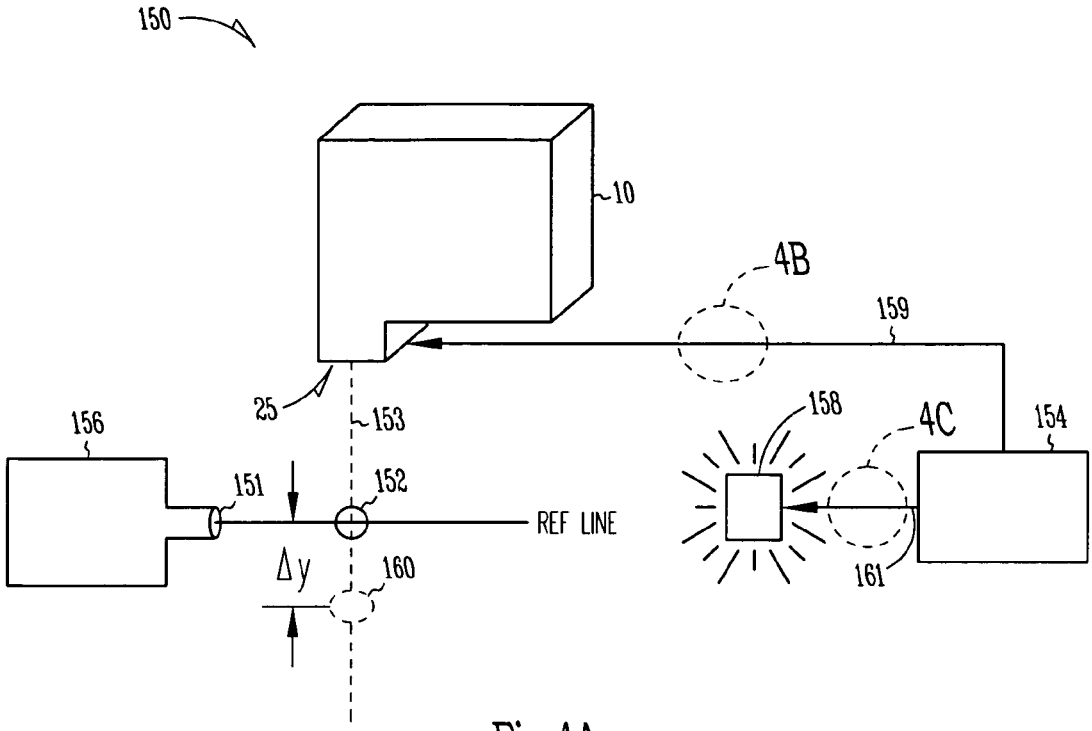
FIG. 4A is a diagrammatic view in accordance with the teachings of the present invention of a first experimental setup.
Figure 4B:
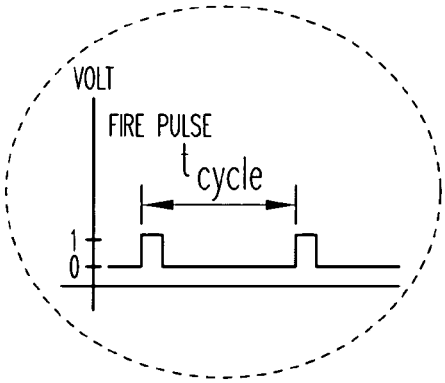
FIG. 4B is a graph in accordance with the teachings of the present invention of a heater chip firing pulse.
Figure 4C:
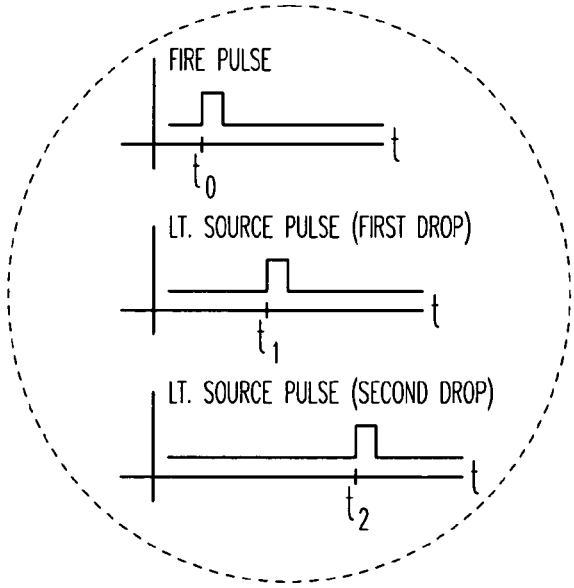
FIG. 4C is a graph in accordance with the teachings of the present invention of a light source pulse.

With reference to FIGS. 4A-4C, a first experimental setup leading to such discovery is shown generally as 150. In particular, a printhead 10 having a single heater (100) of a heater chip 25 is energized or fired to emit a single drop of ink 152 along a trajectory 153. The commands for firing the ink from the heater come from controller 154 along an appropriate signal path 159 and are shown graphically in FIG. 4B. The fire pulse has a period $t_{cycle}$ and ranges in voltage values corresponding to logic "0" or logic "1." A camera 156 captures a picture of the ink drop 152 as it passes a reference line (Ref Line) that extends from the camera lens 151 generally perpendicular to the ink trajectory 153. A light source 158 also receives commands from controller 154. It flashes at appropriate times to assist the camera 156 in capturing a picture or image of the ink drop 152 as it passes Ref Line. The commands issued for the light source 158 are conveyed along signal path 161 by the controller 154 and are shown graphically in FIG. 4C. To facilitate inventor awareness, and so that a user can view the ink drop image captured by the camera, a visual display unit (VDU) (not shown) having the Ref Line superimposed on the screen is connected to the camera.

During use, a fire pulse, beginning at time to is sent from the controller to fire a first ink drop 152 from an individual heater (100) of the heater chip 25 of the printhead 10. The camera captures the image, with assistance from a flash of light from the light source 158, as it passes the Ref Line. The light source pulse for this first drop of ink is sent relative to the fire pulse at some time $t_1$ after time $t_0$.

Thereafter, a second drop of ink is fired relative to the fire pulse and the light source pulse is delayed, after time $t_1$, until time $t_2$. Accordingly, the image captured by the camera 156 for the second ink drop 160 will be further along (ΔY) the trajectory 153 than the first ink drop 152.

Figure 5A:
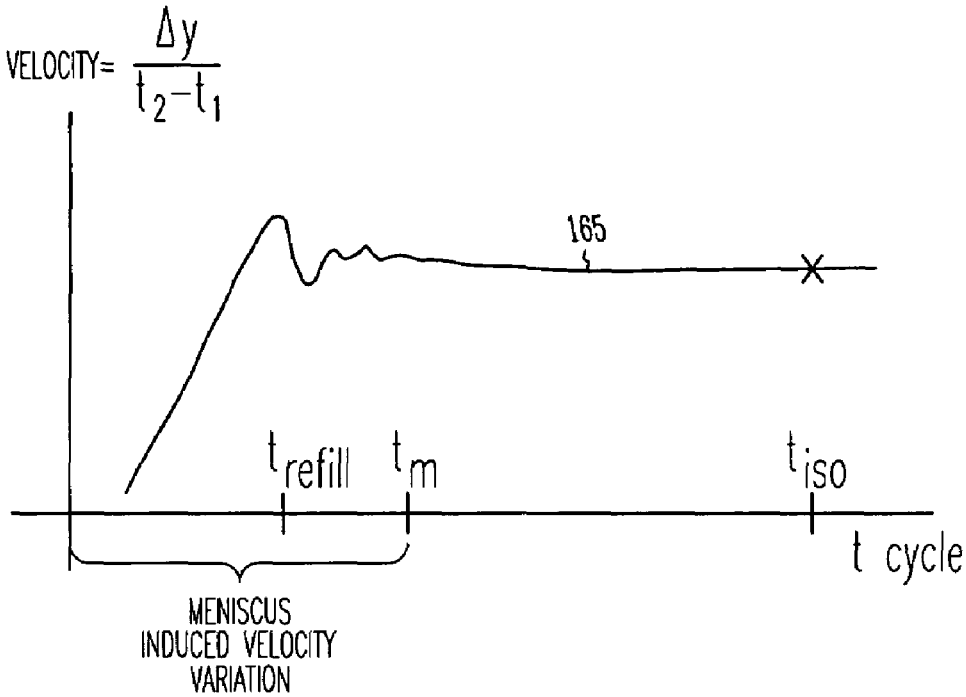
FIG. 5A is a graph in accordance with the teachings of the present invention of a first ink drop velocity plotted versus time.
Figure 5B:
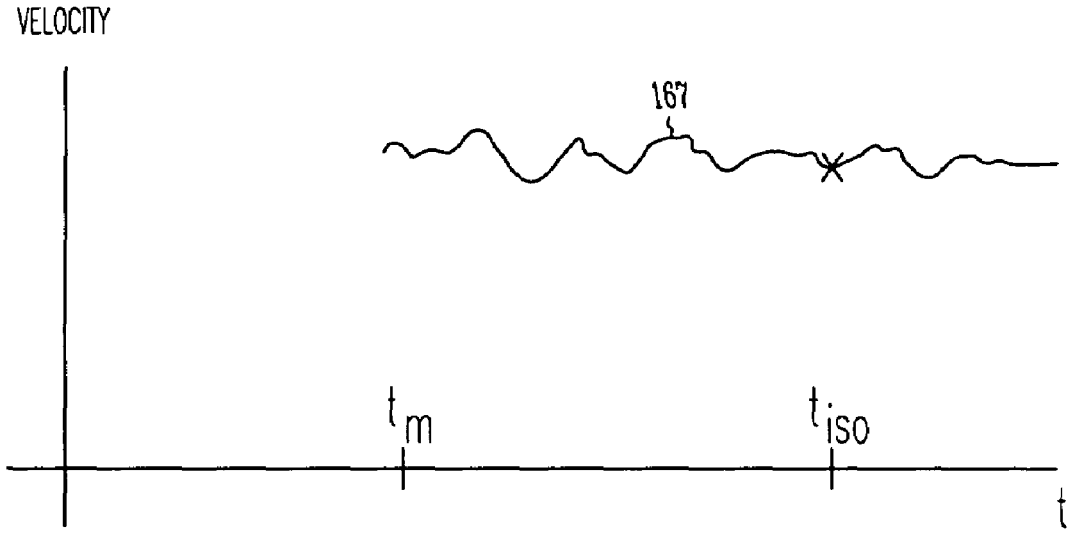
FIG. 5B is a graph in accordance with the teachings of the present invention of a second ink drop velocity plotted versus time.

When plotting ink drop velocity, which is $\Delta Y/(t_2-t_1)$, a graph 165 is discovered like that shown in FIG. 5A. Since meniscus induced variations in velocity can occur at times less than $t_m$ (meniscus time) because of the time it takes to refill the ink chamber, the velocity of the ink drop is examined when it is very stable at an isolation time, $t_{iso}$, at frequencies much smaller than frequencies required to refill the ink chamber at time $t_{refill}$. Thus, if at some time $t_{iso}$, relatively far removed from the meniscus effects on velocity as shown by the X on curve 167 in FIG. 5B, variations in velocity are occurring, it can be deduced that instability is occurring with the way and manner in which the bubble or ink drop is being formed (bubble formation) in the ink chamber.

Figure 6A:
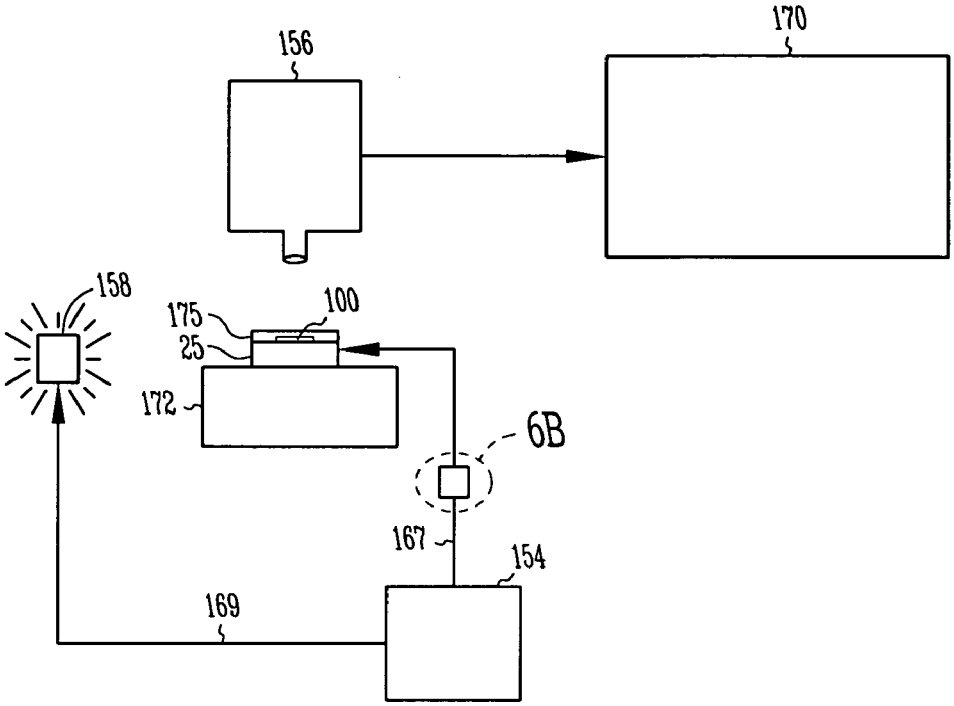
FIG. 6A is a diagrammatic view in accordance with the teachings of the present invention of a second experimental setup.
Figure 6B:
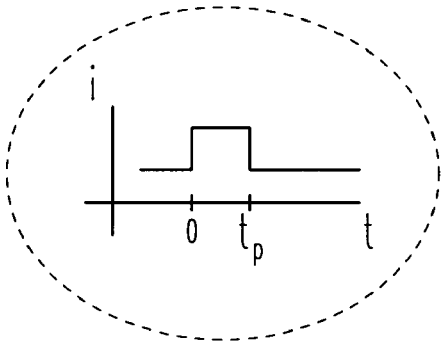
FIG. 6B is a graph in accordance with the teachings of the present invention of a current source pulse.

With reference to FIGS. 6 and 7, a second experimental setup was implemented to investigate bubble formation. In this setup, the camera 156, connected to a VDU 170 so that a user can view the camera results, is positioned above and focused upon a single heater 100 of a heater chip 25. The heater chip 25 is fashioned to a platform 172 capable of multi-dimensional adjustments. A controller 154 provides appropriate signals along signal path 167 to fire the single heater 100. In a manner similar to that of the first experimental setup, a light source 158 receives inputs from the controller 154 along signal path 169. A glass slide 175 is secured over the heater chip 25. A minimal number of water droplets (i.e., one or two) or dye-less ink are placed between the glass slide and the heater chip so that bubble formation of a single heater 100 can be visually observed on the VDU 170 and recorded when the controller fires or energizes the single heater 100. A microscope (not shown) may also be used if the camera 156 is incapable of detailed magnification.

Figure 7A:
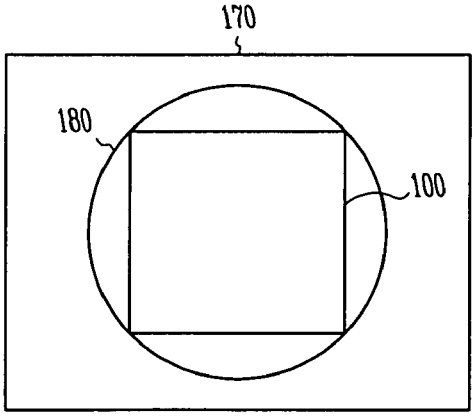
FIG. 7A is a diagrammatic view in accordance with the teachings of the present invention of a stably formed ink drop.
Figure 7B:
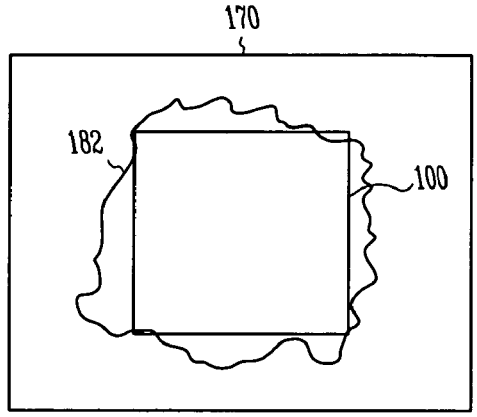
FIG. 7B is a diagrammatic view in accordance with the teachings of the present invention of an unstably formed ink drop.

During use, a current pulse, i (FIG. 6B), is sent from the controller to the single heater 100. The current pulse is of some appropriate ampere magnitude having a time duration from between time zero, 0, to some time length of the pulse, $t_p$. Depending upon the particular pulse parameters, what is observed on the VDU 170 is depicted in FIGS. 7A and 7B. In particular, a predictable, well rounded, generally symmetrically formed, continuously stable (from heater fire-to-fire) bubble 180 or an unpredictable, erratic, poorly shaped, bubble 182. A bubble 180 is typical of a stably formed bubble having a velocity depiction like graph 165 shown in FIG. 5A while bubble 182 is typical of an unstably formed bubble having a velocity depiction like graph 167 in FIG. 5B.

Figure 8:
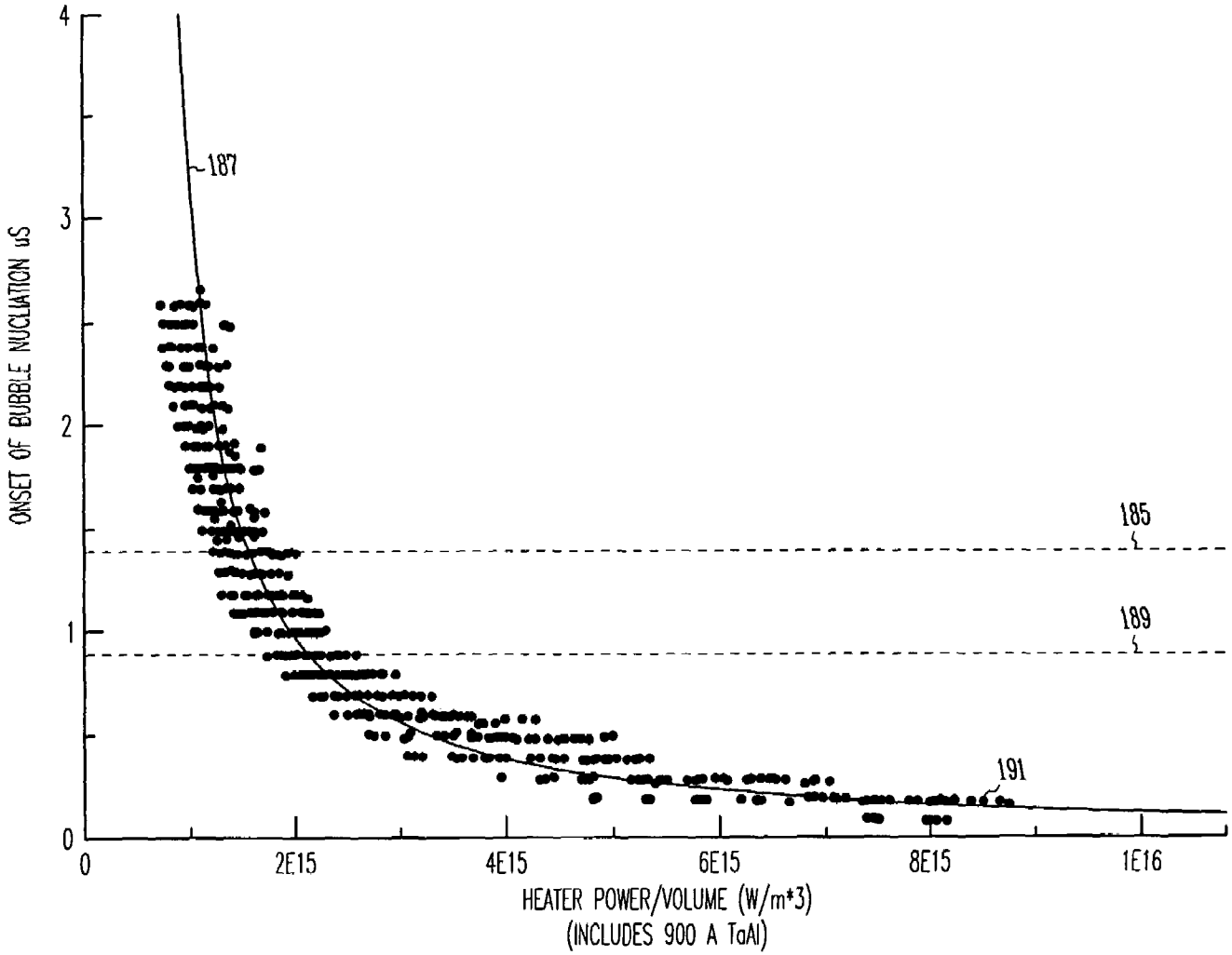
FIG. 8 is a graph in accordance with the teachings of the present invention of the onset of bubble nucleation plotted versus heater power per unit volume.

With reference to FIG. 8, it has been further discovered when plotting data from the two experimental setups regarding the timing of bubble formation (i.e., Onset of Bubble Nucleation (in microseconds) versus a heater's power per unit volume (in $W/m^3$), where the volume dimensions of the heater are obtained from the heater geometry i.e., the heater width, WH, length, LW, and thickness, TH, and power is obtained from the current and voltage pulses supplied to the heater) that very stable bubbles are formed (stable ink jetting performance) with heater powers per volume being greater than about $1.5\times10^{15}$ ($W/m^3$) at a relative position where line 185 intersects the curve 187 fit from the plotted experimental data. Even further, and somewhat arbitrary as a point, extremely stable ink jetting performance is obtained when heater powers per unit volume exceed about $2\times10^{15}$ ($W/m^3$) at a position where line 189 intersects the curve 187.

It should be appreciated that at heater powers per unit volume less than about $1.5\times10^{15}$ ($W/m^3$) functional/working heater chips can be obtained but are susceptible to less stable ink jetting performance. Even further, at higher heater powers per unit volume, at point 191, for example, very stable ink jetting occurs but at the expense of heater life because of the relatively large currents and/or voltages being applied to the heater during its lifetime.

Figure 9:
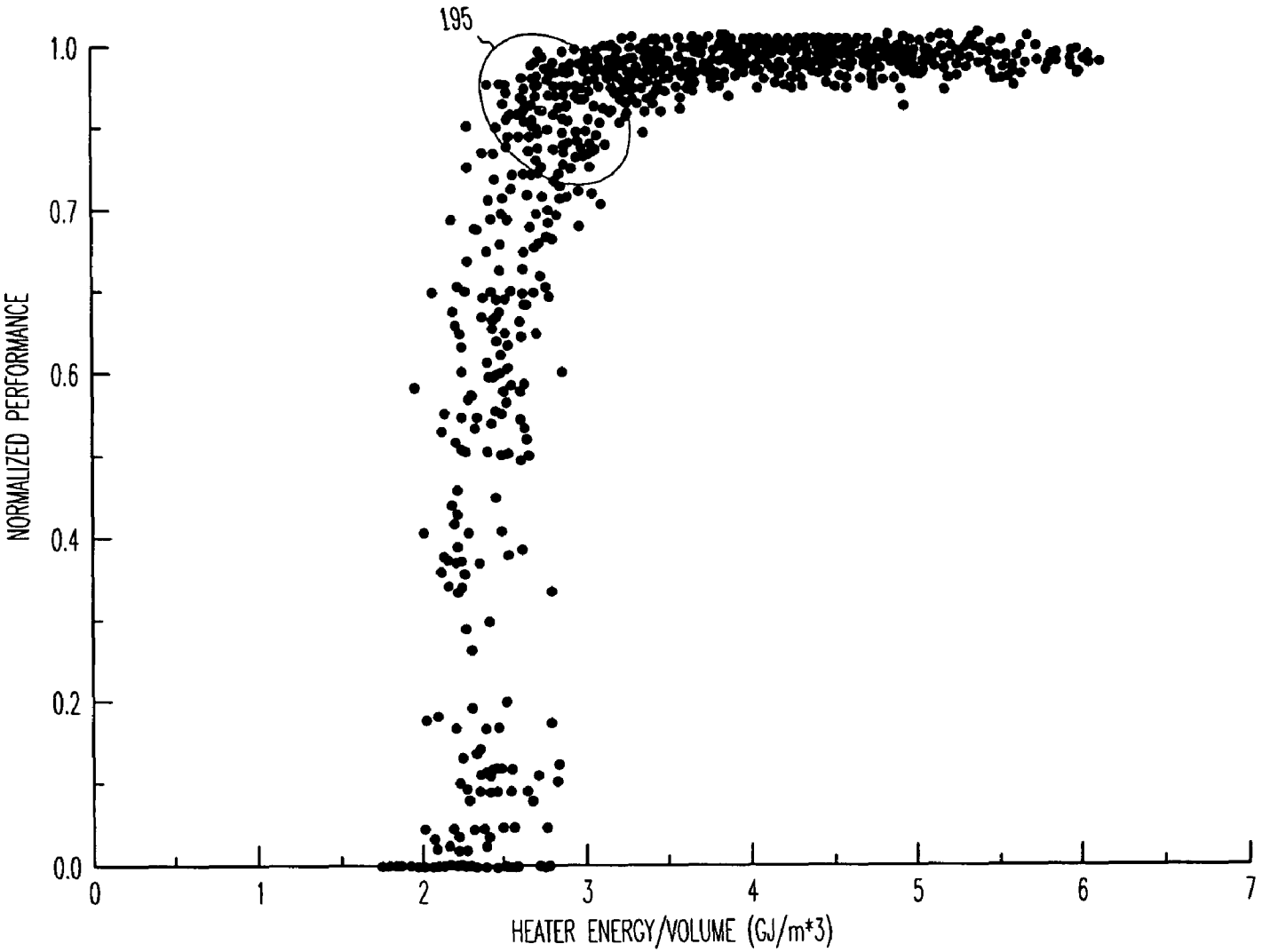
FIG. 9 is a graph in accordance with the teachings of the present invention of a normalized velocity performance plotted versus heater energy per unit volume.

With reference to FIG. 9, to understand how much energy to put into a fire pulse to keep a bubble stable, and provide continually stable and predictable ink jetting performance, numerous data points where obtained by varying heater energy. They were plotted against one another as a normalized velocity curve versus heater energy per volume (in $GJ/m^3$). What was discovered was that stable performance, and thus an understanding of an appropriate heater energy per volume, occurred generally when the data points had higher heater energy per volume to the right of the "knee-bend" of the data points shown in the vicinity of data points 195.

Advantageously, the relationship can now be understood between an individual heater's geometry (i.e., its width, WH, length, LH, and thickness, TH), regardless of the compositions of the layers, and the energy required to stably jet the heater. As a result, for a given heater area and thickness, an energy range can be consistently predicted that results in stable ink jetting performance.

Moreover, printhead costs can now be quantified because it is known that lower costs accrue when heater chips use as little energy as possible for firing heaters. Accordingly, the inkjet printhead arts can now optimize heater configurations to achieve minimal firing energy that support relatively long life, small size, high density, chip stability and good heat dissipation properties. Mathematically, the relationship between the heater geometry and energy per volume of a particular individual heater 100 can now advantageously be expressed as:

$$E_{heater}(\text{Joules/m}^3) = \frac{R_{sheet}}{(WH^2)(TH)}\int_0^{tp} i^2\,dt \qquad \text{(eqn. 1)}$$

$E_{heater}$=Heater energy per unit volume
i=current (Amperes)
t=time (seconds)
$R_{sheet}$=sheet resistance of resistor layer (106)
WH=heater width
TH=heater thickness
tp=pulse duration where LH, WH and TH (and i, and t and the integral) can all be measured and $R_{sheet}$ is a known constant fixed by the thickness and bulk resistivity of resistor layer 106 expressed in ohms/square (square=LH/WH), $$R_{sheet} = \frac{\text{Bulk resistivity of resistor layer (106)}}{\text{thickness of resistor layer (106)}} \qquad \text{(eqn. 2)}$$

and $$i = \sqrt{\frac{(PV)(WH^2)(TH)}{R_{sheet}}}$$

i=Current (Amperes)

where PV is the desired power per unit volume condition from FIG. 8 (i.e., greater than about $1.5\times10^{15}$ ($W/m^3$)).

Numerous data points are summarized in tabular form in FIGS. 10-12 in preferred ranges for heater energy per volume (eqn. 1) for individual heaters on heater chips having a heater area (heater width, WH, multiplied by heater length, LH) ranging from about 50 to about 4000 micrometers squared and for heater thicknesses, TH, ranging from about 500 to about 16,000 angstroms.

As a working example, consider an individual heater 100 with a heater area (heater width, WH, multiplied by heater length, LH) of about 50 micrometers squared and a heater thickness of about 500 angstroms. The energy range in microjoules required to stably jet ink from such a heater would be in a range from about 0.007 to about 0.01 in accordance with table entry 200 in FIG. 12. Such range, about 0.007 to about 0.01, corresponds to heater energy per volume generally occurring with data points having higher energy per volume to the right of the "knee-bend" of the data points shown in the vicinity of data points 195 of FIG. 9. Consider another individual heater 100 with a heater area (heater width, WH, multiplied by heater length, LH) of about 500 micrometers squared and a heater thickness of about 5000 angstroms. The energy range in microjoules required to stably jet ink from such a second heater would be in a range from about 0.74 to about 0.99 in accordance with the circle entry in FIG. 10. Thus, an individual heater 100 having a heater area (the heater length, LH, multiplied by the heater width WH) in a range from about 50 to about 500 micrometers squared and a heater thickness, TH, in a range from about 500 to about 5000 angstroms requires an energy per volume to emit an ink drop from the heater during use is in a range from about 0.007 to about 0.99 microjoules.

The present invention has been particularly shown and described with respect to certain preferred embodiment(s). However, it will be readily apparent to those skilled in the art that a wide variety of alternate embodiments, adaptations or variations of the preferred embodiment(s), and/or equivalent embodiments may be made without departing from the intended scope of the present invention as set forth in the appended claims. Accordingly, the present invention is not limited except as by the appended claims.

What is claimed is:

1. A heater chip for an inkjet printhead, comprising:
a substrate;
a thermal boundary layer on the substrate;
a resistor layer having a resistor thickness and a resistor width on the thermal boundary layer, the resistor width defining a heater width;
a conductor layer on the resistor layer defining a heater length; and
an overcoat layer having an overcoat thickness on the resistor layer, the overcoat thickness and the resistor thickness defining a heater thickness wherein the heater length multiplied by the heater width is in a range from about 50 to less than 250 micrometers squared and the heater thickness is in a range from about 500 to about 6000 angstroms.

2. The heater chip of claim 1, wherein the overcoat layer comprises a passivation layer and a cavitation layer.

3. The heater chip of claim 2, wherein the passivation layer comprises a dielectric layer.

4. The heater chip of claim 1, wherein an energy to emit an ink drop from the heater chip during use is in a range from about 0.007 to about 0.06 microjoules.

5. The heater chip of claim 1, wherein the thermal boundary layer is at least about 1 micron in thickness.

6. An inkjet printhead, comprising:
a housing; and
a heater chip attached to the housing, the heater chip having
a substrate;
a thermal barrier layer on the substrate;
a resistor layer having a resistor thickness and a resistor width on the thermal
barrier layer, the resistor width defining a heater width;
a conductor layer on the resistor layer defining a heater length; and
an overcoat layer having an overcoat thickness on the resistor layer and the
conductor layer, the overcoat thickness and the resistor thickness defining a heater thickness wherein the heater length multiplied by the heater width is in a range from about 50 to less than 250 micrometers squared and the heater thickness is in a range from about 500 to about 5000 angstroms.

7. The printhead of claim 6, wherein the housing comprises a supply of ink and the heater chip has an ink via in fluidic access with the supply of ink.

8. The printhead of claim 6, further comprising a TAB circuit electrically connected to a bond pad on the heater chip.

9. An inkjet printer, comprising:
at least one printhead having a supply of ink and a heater chip, the heater chip having
a substrate;
a thermal barrier layer on the substrate;
a resistor layer having a resistor thickness and a resistor width on the thermal
barrier layer, the resistor width defining a heater width;
a conductor layer on the resistor layer defining a heater length; and
an overcoat layer having an overcoat thickness on the resistor layer and the conductor layer, the overcoat thickness and the resistor thickness defining a heater thickness wherein the heater length multiplied by the heater width is in a range from about 50 to about 350 micrometers squared and the heater thickness is less than 1100 angstroms; and
a carriage for holding the at least one printhead capable of reciprocating movement over a print zone during use.

10. The printer of claim 9, wherein the supply of ink is locally configured within a housing of the printhead.

11. A heater chip for an inkjet printhead, comprising:
a substrate;
a thermal barrier layer on the substrate;
a resistor layer having a resistor thickness and a resistor width on the thermal barrier layer, the resistor width defining a heater width;
a conductor layer on the resistor layer defining a heater length; and
an overcoat layer, comprised of a passivation layer and a cavitation layer, having an overcoat thickness on the resistor layer and the conductor layer, the overcoat thickness and the resistor thickness defining a heater thickness wherein the heater length, the heater width and the heater thickness define a heater, the heater length multiplied by the heater width is in a range from about 50 to about 350 micrometers squared and the heater thickness is in a range from about 500 to about 6000 angstroms and the heater is adapted to emit an ink drop with an energy pulse in a range from about 0.007 to about 0.83 microjoules.

12. The heater chip of claim 11, wherein the passivation layer is selected from at least one of a silicon nitride, a silicon carbide and a diamond like carbon layer.

13. The heater chip of claim 11, wherein the conductor layer has an anode and a cathode, a distance between the anode and cathode on a surface of the resistor layer defining the heater length.

14. The heater chip of claim 11, wherein the cavitation layer is a tantalum layer.

15. The heater chip of claim 11, wherein the resistor layer is a layer having at least one of Hf, Ta, Ti, W, $HfB_2$, $Ta_2N$, TaAl(N,O), TaAlSi, TaSiC, Ta/TaAl layered resistor, Ti(N,O) and WSi(O) therein.

16. A heater chip for an inkjet printhead, comprising:

a substrate;

an ink via in the substrate adapted to receive a supply of ink from the printhead;

a thermal baffler layer on the substrate;

a resistor layer having a resistor thickness and a resistor width on the thermal baffler layer, the resistor width defining a heater width;

a conductor layer on the resistor layer, the conductor layer having an anode and a cathode with a distance between the anode and the cathode on a surface of the resistor layer defining a heater length; and an overcoat layer, comprised of a passivation layer and a cavitation layer, having an overcoat thickness and the resistor thickness defining a heater thickness wherein the heater length, the heater width and the heater thickness define a heater, the heater being arranged adjacent the ink via wherein the heater length multiplied by the heater width is in a range from about 50 to about 350 micrometers squared and the heater thickness is in a range from about 500 to about 5000 angstroms, the heater being adapted to emit an ink drop of the supply of ink with an energy pulse applied to the conductor layer in a range from about 0.007 to about 0.69 microjoules.

17. A heater chip for an inkjet printhead, comprising:

a substrate;

a thermal barrier layer on the substrate;

a resistor layer having a resistor thickness and a resistor width on the thermal barrier layer, the resistor width defining a heater width;

a conductor layer on the resistor layer defining a heater length; and an overcoat layer having an overcoat thickness on the resistor layer, the overcoat thickness and the resistor thickness defining a heater thickness wherein the heater length multiplied by the heater width is less than about 400 micrometers squared and the heater thickness is less than about 4000 angstroms and wherein an energy to emit an ink drop from the heater hip during use is less than about 0.64 microjoules.

18. The heater chip of claim 17, wherein the overcoat layer comprises a passivation layer and a cavitation layer.

19. The heater chip of claim 18, wherein the passivation layer comprises a dielectric layer.

20. The heater chip of claim 19, wherein the thermal barrier layer is at least about 1 micron in thickness.

21. A heater chip for an inkjet printhead, comprising:

a substrate;

a thermal barrier layer on the substrate;

a resistor layer having a resistor thickness and a resistor width on the thermal barrier layer, the resistor width defining a heater width;

a conductor layer on the resistor layer defining a heater length; and an overcoat layer having an overcoat thickness on the resistor layer, the overcoat thickness and the resistor thickness defining a heater thickness wherein the heater length multiplied by the heater width is in a range from about 50 to about 500 micrometers squared and the heater thickness is in a range from about 500 to about 1000 angstroms.

22. A heater chip for an inkjet printhead, comprising:

a substrate;

a thermal barrier layer on the substrate;

a resistor layer having a resistor thickness and a resistor width on the thermal barrier layer, the resistor width defining a heater width;

a conductor layer on the resistor layer defining a heater length; and an overcoat layer having an overcoat thickness on the resistor layer, the overcoat thickness and the resistor thickness defining a heater thickness wherein the heater length multiplied by the heater width is in a range from about 50 to about 350 micrometers squared and the heater thickness is in a range from about 500 to less than about 1000 angstroms.

23. A heater chip for an inkjet printhead, comprising:

a substrate;

a thermal baffler layer on the substrate;

a resistor layer having a resistor thickness and a resistor width on the thermal baffler layer, the resistor width defining a heater width;

a conductor layer on the resistor layer defining a heater length; and an overcoat layer having an overcoat thickness on the resistor layer, the overcoat thickness and the resistor thickness defining a heater thickness wherein the heater length multiplied by the heater width is less than about 400 micrometers squared and the heater thickness is less than 1100 angstroms.

24. A heater chip for an inkjet printhead, comprising:

a substrate;

a thermal barrier layer on the substrate;

a resistor layer having a resistor thickness and a resistor width on the thermal barrier layer, the resistor width defining a heater width;

a conductor layer on the resistor layer defining a heater length; and an overcoat layer having an overcoat thickness on the resistor layer, the overcoat thickness and the resistor thickness defining a heater thickness wherein the heater length multiplied by the heater width is less than 400 micrometers squared and the heater thickness is in a range from about 500 to about 6000 angstroms.

25. A heater chip for an inkjet printhead, comprising:

a substrate;

a thermal barrier layer on the substrate;

a resistor layer having a resistor thickness and a resistor width on the thermal barrier layer, the resistor width defining a heater width;

a conductor layer on the resistor layer defining a heater length; and an overcoat layer having an overcoat thickness on the resistor layer, the overcoat thickness and the resistor thickness defining a heater thickness wherein the heater length multiplied by the heater width is in a range from about 50 to about 500 micrometers squared and the heater thickness is in a range from about 500 to less than about 1000 angstroms.

* * * * *